US006039090A

United States Patent [19]

Gunn et al.

[11] Patent Number: 6,039,090

[45] Date of Patent: Mar. 21, 2000

[54] PRESSURIZABLE BEVERAGE VESSELS

[75] Inventors: Brian Leslie Gunn, Tenbury Wells; James Moore, Ledbury; Michael Turley Hancocks, Fairacre, all of United Kingdom

[73] Assignee: Able Industries Limited, Tenbury Wells, United Kingdom

[21] Appl. No.: 08/983,405

[22] PCT Filed: Jul. 19, 1996

[86] PCT No.: PCT/GB96/01741

§ 371 Date: Apr. 30, 1998

§ 102(e) Date: Apr. 30, 1998

[87] PCT Pub. No.: WO97/03890

PCT Pub. Date: Feb. 6, 1997

[30] Foreign Application Priority Data

Jul. 20, 1995 [GB] United Kingdom ..... 9514870
May 31, 1996 [GB] United Kingdom ..... 9611353

[51] Int. Cl.[7] ..... B67C 3/00

[52] U.S. Cl. ..... 141/17; 141/22; 141/63; 141/64; 141/70; 222/399; 220/240; 215/228

[58] Field of Search ..... 141/3, 14, 17, 141/22, 63, 64, 65, 70, 379, 380, 381; 222/399; 261/DIG. 7; 99/323.1; 215/228, 307, 341, 343, 270, 271, 320, 354; 220/212, 367.1, 240, 304; 426/115, 394, 397

[56] References Cited

U.S. PATENT DOCUMENTS

| | | | |
|---|---|---|---|
| 1,905,986 | 4/1933 | Jacobs et al. | 141/65 |
| 4,487,326 | 12/1984 | Uhlig | 215/307 |
| 4,747,511 | 5/1988 | Dutt et al. | 220/307 |
| 5,251,770 | 10/1993 | Bartley et al. | 215/270 |
| 5,458,252 | 10/1995 | Logel | 220/240 |

FOREIGN PATENT DOCUMENTS

| | | |
|---|---|---|
| 707837 | 4/1968 | Belgium . |
| 250343 | 12/1987 | European Pat. Off. . |
| 594221 | 4/1994 | European Pat. Off. . |
| 636550 | 2/1995 | European Pat. Off. . |
| 2284590 | 6/1995 | United Kingdom . |
| WO9324383 | 12/1993 | WIPO . |
| WO9416966 | 8/1994 | WIPO . |

*Primary Examiner*—Steven O. Douglas
*Assistant Examiner*—Timothy L. Maust
*Attorney, Agent, or Firm*—Christie, Parker & Hale, LLP

[57] ABSTRACT

An improved pressurizable wide mouthed vessel is provided which is capable of storing beverages under pressure and also of being used as a drinking vessel. The wide mouthed drinking vessel is closed by a closure urging a seal to sealingly engage the vessel. The closure is so configured that when the vessel is pressurized, the closure is deformed to transmit additional pressure to the seal to effect tighter sealing engagement with the vessel. The closure has pressure release means for venting the vessel in order to release the pressure on the seal, and so allow the closure to be more readily removed from the mouth of the vessel.

24 Claims, 4 Drawing Sheets

PRESSURIZABLE BEVERAGE VESSELS

BACKGROUND OF THE INVENTION

The present invention relates to pressurizable beverage vessels.

Bars which dispense beer and other beverages are often faced with peak periods of activity during which drinks must be poured and sold. The speed at which drinks can be dispensed is slowed down by the fact that it takes time to pour beverages into drinking vessels such as beer glasses. While pouring could be effected during a quiet spell, before the expected peak period, any drinks so poured would be likely to become flat and so unpalatable. Also, it is rarely possible to gauge the exact demand in advance and so too many drinks may be poured and be wasted.

SUMMARY OF THE INVENTION

It is an object of the present invention to provide an improved wide mouthed vessel which is capable of storing beverages under pressure and also of being used as a drinking vessel.

According to the present invention there is provided a pressurisable container for containing a liquid under pressure comprising a wide mouthed drinking vessel and a closure to close the mouth of the vessel, the closure urging a seal to sealingly engage the vessel, the closure being so configured that when the vessel is pressurised, the closure is deformed to transmit additional pressure to the seal to effect tighter sealing engagement with the vessel, the closure having pressure release means for venting the vessel to release the pressure on the seal and so allow the closure to be more readily removed from the mouth of the vessel.

Preferably means are provided separate from said seal for locking said closure to said vessel. The locking means may take the form of a screw-thread engaging corresponding screw-thread on the vessel.

The seal advantageously is in the form of a flexible annular flange arranged to lie close to the inner face of the vessel, the flange being pivotably supported at one axial end and engaged between opposite axial ends by a domed shaped cap member, the domed shaped cap member, when subjected to pressure from within the container expanding circumferentially to pivot the annular flange about said one axial end into tighter engagement, with the adjacent wall of the container.

Preferably, the inner face of the mouth of the container and the outer face of the flange, when in its relaxed state are convergent in a direction towards the base of the container.

According to the present invention there is still further provided a jetting device for use in a pressurized container, said device comprising a body defining a chamber having an opening, a closure device slidably engaging said opening and constrained in said opening for movement between first and second positions, whereby when in said first position, it closes said opening and in said second position it vents said opening, said closure device being initially assembled into said body in said first portion and being moved from said first to said second position immediately prior to installation in said container.

Preferably, the body comprises a first cylindrical member and the closure comprises a second cylindrical member telescopically engaged with said first member and an annular seal rigid with one said member is provided between the outer surface of the second member and the inner surface of the first member, there being axially extending grooves in said other member over a limited axial extent of the said other member so that when the seal is displaced to engage said axial extent, the grooves provide a by-pass path between the first and second members.

Preferably stop means are provided to limit the range of axial displacement of the first member relative to the second member.

According to the present invention there is yet further provided a jetting device for use in a pressurized container, the device comprising an elongate body defining a chamber open at one axial end and a closure device for sealingly closing said open axial end to hold a predetermined gas environment within said chamber and the closure being movable to vent said chamber just prior to installation in said container.

Preferably there is provided a passage in the wall of one of said body and closure device which is open when said closure device is in a first position relative to said body and closed when said closure device is in second position relative to said body.

Advantageously, the closure device is cylindrical and telescopically engaged with said body.

Means may be provided once said closure device engages said body to imprison said closure device for movement only between the first and second positions.

The pressurized container may be closed by a closure having a socket on its underside into which a said aforementioned jetting device can be plugged.

BRIEF DESCRIPTION OF THE DRAWINGS

Wide mouthed pressurizable vessels will now be described, by way of example, with reference to the accompanying diagrammatic drawings, in which.

DETAILED DESCRIPTION

Figure 1:
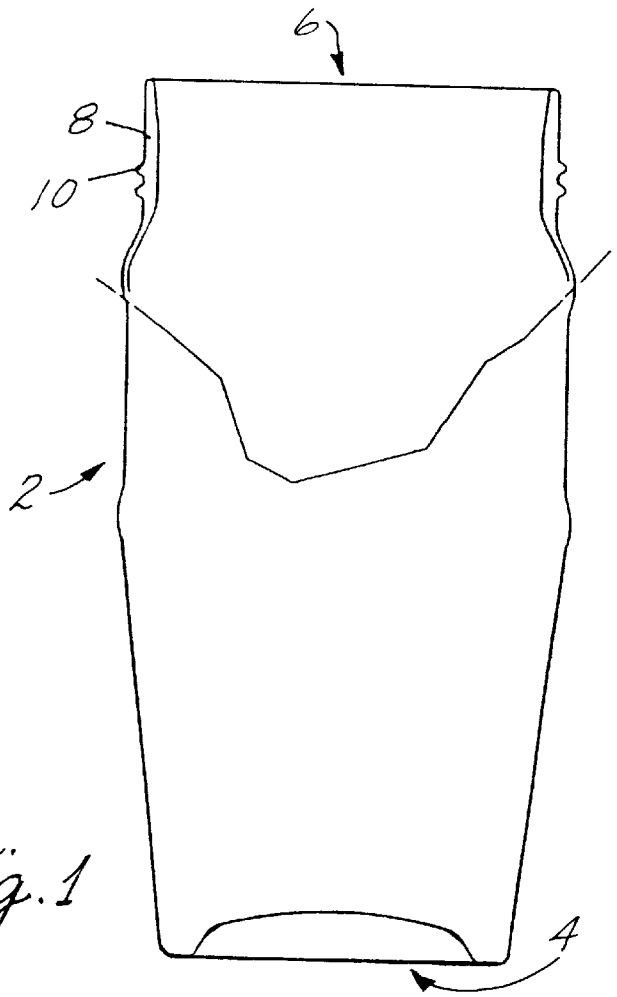
FIG. 1 is a front elevation of a first vessel when used as a drinking vessel.

FIG. 1 shows a wide mouthed vessel 2, without closure, suitable for drinking a beverage such as beer or other carbonated drink. The vessel may be of plastics, glass or other material suitable both for withstanding pressure and hygiene. The container 2 has a mouth 6 which is wider than its base 4. The base 4 is inwardly domed to withstand pressure when the vessel is pressurised.

Figure 2:
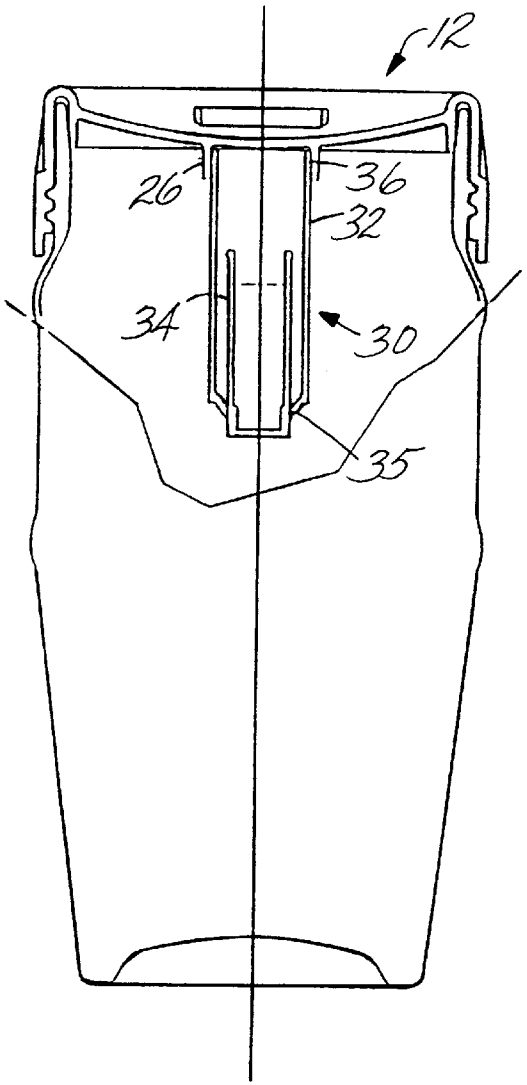
FIG. 2 is a front elevation shown partly cut away of the vessel of FIG. 1 with a closure when used as a storage vessel.
Figure 4:
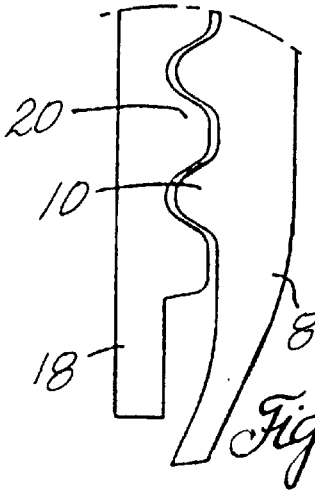
FIG. 4 is a detail to an enlarged scale of how the closure is locked to the rim of the vessel.
Figure 5:
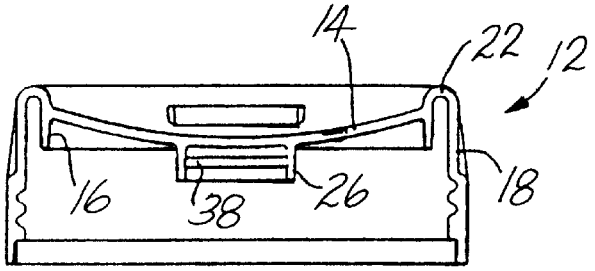
FIG. 5 is a section taken through the closure.
Figure 6:
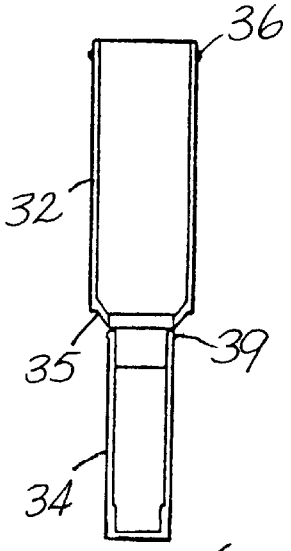
FIG. 6 is a front elevation of a jetting device as initially moulded.

The upper end portion of the vessel is generally cylindrical and forms a neck 8 which has a greater wall thickness than the remainder of the container. The outer face carries a screw-thread 10 having its upper extremity spaced at least 1 cm from the upper rim of the container. The vessel 2 is arranged to store a beverage under pressure and it can do so with the aid of a closure 12. FIG. 2 shows the vessel with the closure 12 in place. The closure 12, which is shown on its own in FIG. 5, is of plastic and has a circular concave central region 14 which is encircled by an annular doubled skinned wall. The inner and outer skins 16 and 18 of the wall define an annular space which can receive the neck 8 of the vessel 2. The outer skin 18 defines on its inner face a screw-thread 20 which can screw-threadedly engage the screw-thread 10 on the neck 8 to hold the closure securely on the vessel 2 (see FIG. 4). The two skins 16 and 18 are linked at their upper end by a transverse portion 22 of generally inverted U-shaped cross section. The central region 14 is integral with the inner skin 16 at a location intermediate its opposite axial ends. The lower end portion of the inner skin has an annular circumferentially extending recess 24 in its outer surface.

Figure 3:
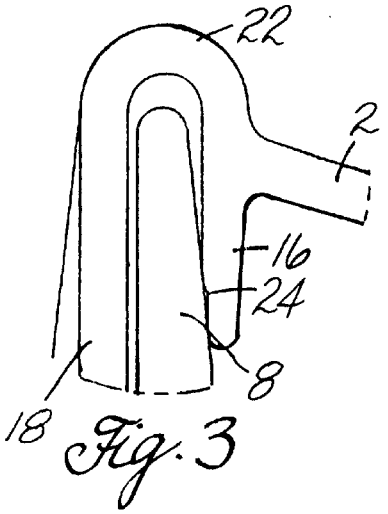
FIG. 3 is a detail to an enlarged scale of how the closure of FIG. 2 is sealed to the inner rim of the vessel.

It will be appreciated that when the closure 12 is secured to the vessel 2 and the vessel is pressurized, the pressure inside the vessel will bear on the inner face of the domed central region 14 in a sense to reduce the curvature of the dome. This in turn will tend to expand the circumference of the region 14 and so cause the inner skin to pivot radially outwardly about the line along which its joins the transverse portion 22 and into contact with the inner face of the neck 8. The inner face of the neck 8 is slightly convergent in the direction of the base 4. The existence of the recess 24 ensures that the skin 16 makes contact with the neck 8 along two axially spaced circular lines of contact and thereby provides an effective double seal with the vessel 2 (see FIG. 3). The screw-threaded engagement between the two screw-threads 10 and 20 prevents the seals from riding up the neck 8. The greater the pressure inside the vessel the greater will be the force with which the seals are urged into contact with the neck 8.

The closure 12 carries centrally on its inner face, a downwardly depending tubular socket 26. Plugged into the socket 26 is a jetting or gassing device.

The jetting or gassing device is a device which defines a chamber to be located within the vessel. The chamber can be filled with gas or a mixture of gas and beverage under pressure. The chamber has an orifice located below the level of the beverage in the vessel and through which the fluid in the chamber can be released into the beverage when the vessel is depressurized to create bubbles in the beverage.

As shown in FIG. 2, the device 30 comprises an outer tubular member 32 and an inner tubular member 34. The lower end portion of the outer member 32 is tapered inwardly into engagement with the inner member 34 to form a bush 35 in which the inner member 34 can slide relative to the outer member 32. The upper end portion of the outer member 32 carries a radially outwardly projecting annular rib 36 which can be snap fitted into an annular recess 38 in the inner face of the socket 26 to lock the device 30 sealingly with the socket 26. The inner member 34 is closed at its lower end portion but is open at its upper end portion. The upper end portion carries a pair of radially outwardly directed latches 39 each of which is tapered in such a sense that it can be push fitted through the bush 35 but prevented from returning by virtue of an inwardly stepped configuration on a side of the latch 38 remote from the open end. The lower end portion of the inner member 34 has a thicker wall than the remainder and defines in the external surface thereof a plurality of circumferentially spaced axially extending grooves 40 each having an axial length longer than the axial length of the bush 35.

In operation, the device is assembled by inserting the inner member 34 into the outer member 32. The coupled inner and outer members 34 and 32 are then plugged into the socket 26 in an environment of a particular gas (for example nitrogen). The particular gas is then sealed inside the device and the closure and the device can then again be subjected to more usual environmental conditions before installation in the vessel.

Figure 7:
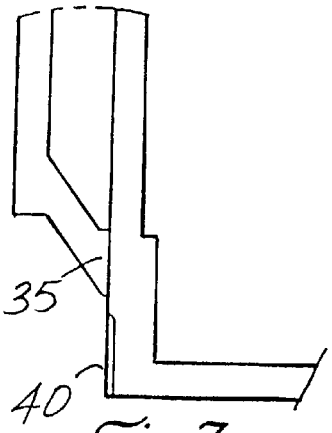
FIG. 7 is a detail of the jetting device to an enlarged scale when unvented.
Figure 8:
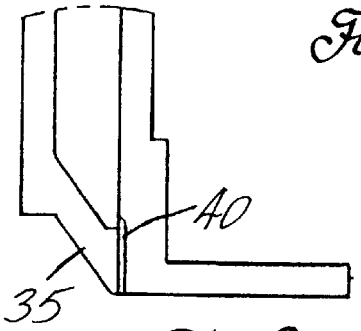
FIG. 8 is a detail of the jetting device to an enlarged scale when vented.

The vessel 2 is filled with a gas saturated beverage but leaving a head space. The inner and outer members 34 and 32 are axially displaced to move the inner member 34 from the closed position shown in FIG. 7 to the open position shown in FIG. 8. The closure 12 is then screwed into the vessel.

Gas will slowly release from the beverage to create a pressure within the vessel and so increase the sealing action of the closure on the vessel. Because the chamber within the device 30 is now open, the pressure between the chamber and the vessel will now equalizes. This may involve the entry of some beverage into the chamber. The vessel is now ready for removal and transport to its site of use.

The central region 14 of the closure 12 is provided with a rupturable vent (not shown) in an area between the inner skin 16 and the socket 26. The rupturable vent may be in the form of a ring pull device or other device for venting the head space of the vessel 2 to an atmosphere. The venting of the head space will release a jet of fluid from the device into the beverage and slacken the seal between the inner skin 16 and the neck 8 of the vessel. Frothing of the beverage will occur and the closure can be readily unscrewed from the vessel 2 to present the beverage in a frothed condition ready to drink direct from the vessel.

If the vessel is of lightweight plastics, it can be discarded after use and being lightweight, cannot be used as an effective projectile by undisciplined users.

It will be appreciated that when the closure 12 is screwed onto the vessel 2 in the absence of any pressure differential between the inside and the outside of the vessel, the inner skin only lightly touches the neck 8 of the vessel 2. It is only when the pressure inside exceeds the pressure outside that the inner skin is forced against its own resilience into tight sealing engagement with the neck. Because of this, when the pressure inside the vessel is released, the inner skin will, under its own natural resilience, tend to move away from the neck to slacken the seal and so allow the closure to be more readily unscrewed.

Figure 9:
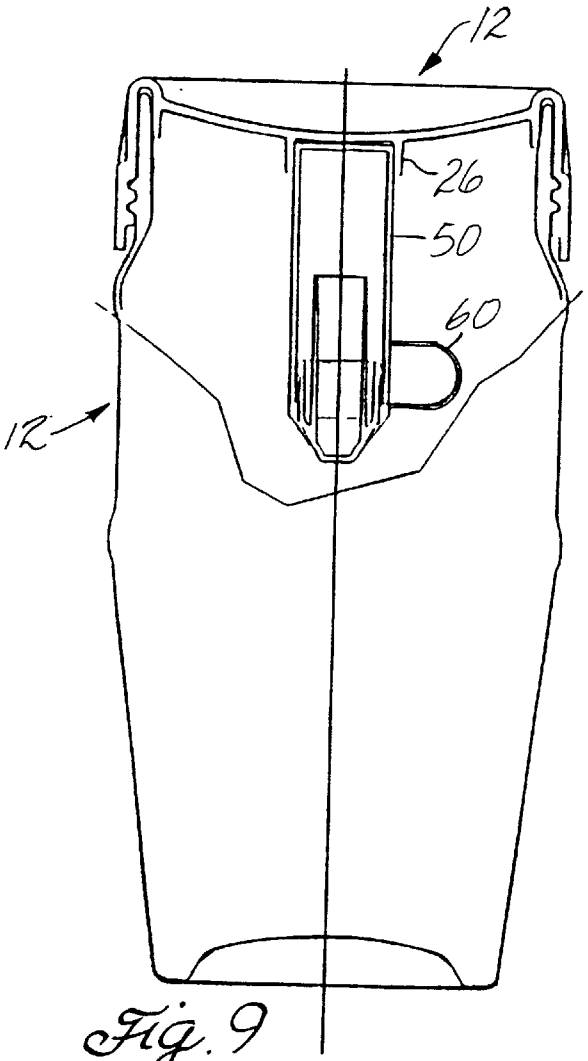
FIG. 9 is a front elevation shown partly cut away of a second vessel with a closure when used as a storage vessel.
Figure 14:
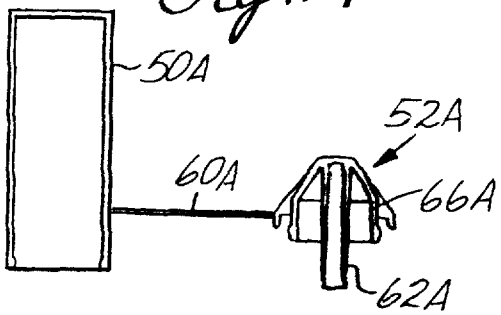
FIG. 14 is a front elevation of the jetting device of FIG. 13 as initially installed in the closure.
Figure 15:
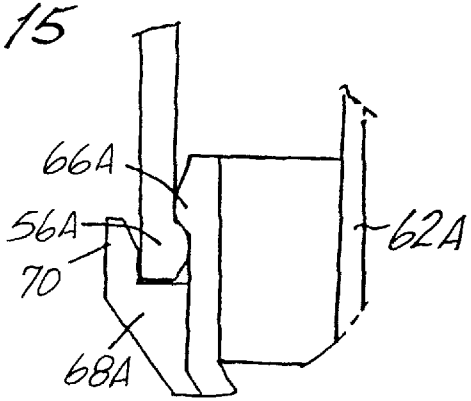
FIG. 15 is a detail to an enlarged scale of the jetting device when installed in the closure.
Figure 13:
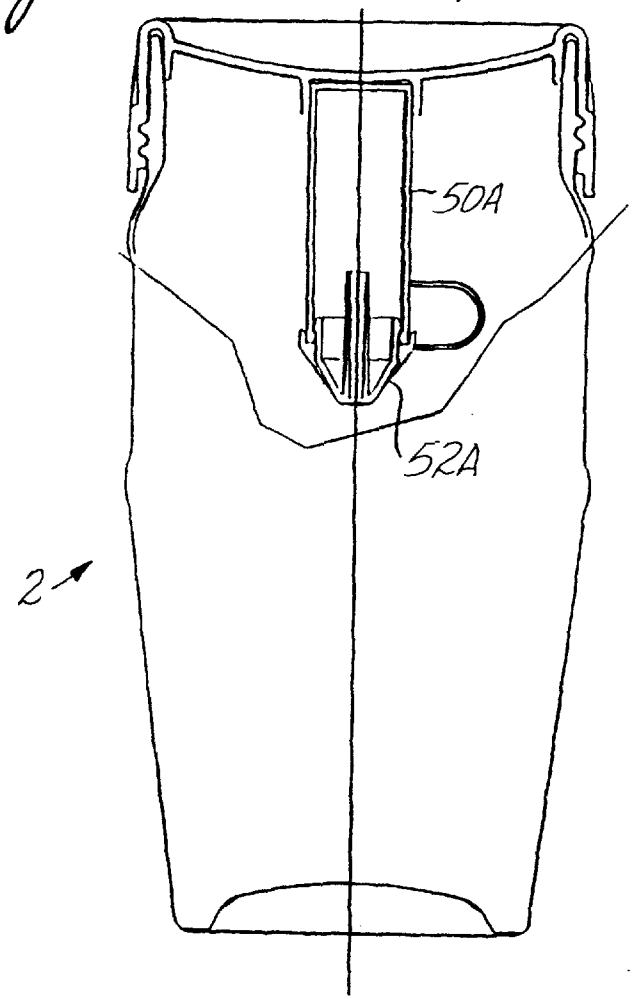
FIG. 13 is a front elevation shown partly cut away of a third vessel with a closure when used as a storage vessel.

FIG. 9 shows a vessel and closure incorporating a modified jetting device. The vessel and closure are similar to those disclosed in FIG. 2 and so are similarly referenced.

Figure 10:
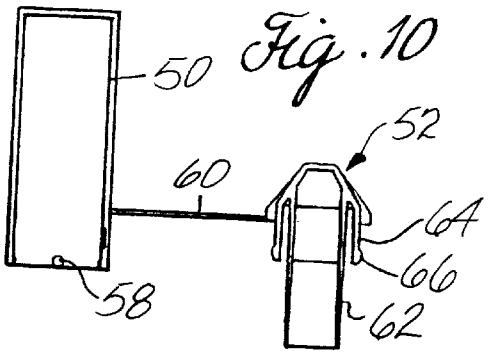
FIG. 10 is a front elevation of the jetting device of FIG. 9 as initially moulded.

The jetting device is produced as a one piece plastics molding as shown in FIG. 10. The jetting device consists of a tube 50 closed at its upper end and open at its lower end and a closure 52 for closing the lower end of the tube 50.

Figure 11:
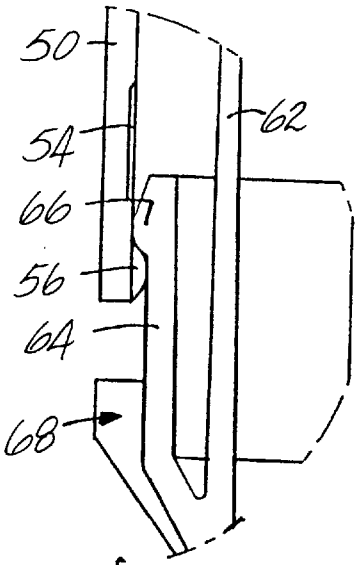
FIG. 11 is a detail of the jetting device of FIG. 10 to an enlarged scale when unvented.

The upper end portion of the tube 50 is arranged to be press-fitted into the socket 26 of the closure 12. The lower end portion of the tube has on its inner face a plurality of axially extending circumferentially spaced grooves 54 (see FIG. 11). Below the grooves and axially spaced from them is a radially inwardly directed circumferentially extending rib 56.

The closure 52 is linked to the tube 50 by a flexible strip 60 produced during the molding process.

The closure 52 consists of a tube 62 closed at its lower end (when viewed in FIG. 9) of narrower diameter than the internal diameter of tube 50.

A skirt 64 encircles the tube 50 and extends axially upwardly from the lower end portion of the tube 52 to lie in radially spaced relationship with the tube 62. At its upper end portion (as viewed in FIG. 9) the skirt 64 carries a circumferentially extending radially outwardly directed rib 66. The ribs 56 and 66 form an interference fit so that when the closure 52 is forced onto the lower end of the tube. The rib 66 rides over the rib 56 and so locks the closure 52 to the tube 50. The rib 66 sealing engages the inner wall of the tube 50 and the rib 56 sealingly engages the outer wall of the skirt 64.

An annular stop member 68 encircles the skirt 64 and is arranged to engage the lower end of the tube 50. The closure 52 thus can slide relative to the tube 50 between a lower position in which the rib 66 engages the rib 56 and an upper position in which the abutment 68 engages the tube 50. In the lower position, the rib engages a portion of the inner face of the tube which is not transversed by the grooves 54 while in the upper positions the rib 56 engages a portion of the inner face of the tube 50 transversed by the grooves. It will thus be appreciated that when the closure 52 is in the lower position the chamber within the tube 50 is sealed shut while when the closure 52 is in the upper position any fluid in the chamber can escape along the grooves 54 past the rib 66 (see FIG. 12) and out through a vent orifice 58 in a lower portion of the tube 50 (see FIG. 10).

In operation, the closure 52 is fitted to the tube 50 in an environment of a particular gas (e.g., nitrogen) and left with the closure in the lower position. The nitrogen is thus sealed within the tube 50 and the device can be removed to a normal environment where it can be fitted into the socket 26 of the closure 12.

Figure 12:
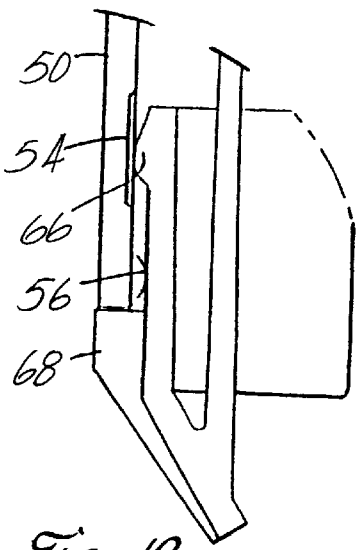
FIG. 12 is a detail of the jetting device of FIG. 11 to an enlarged scale when vented.

Just prior to fitting the closure 12 to the vessel the closure 52 is displaced to its upper position (see FIG. 12). Gas and liquid under pressure will be forced into the chamber via the vent 58 and the grooves.

When the vessel is required for use, the closure 12 is vented and fluid is then forced under pressure out of the chamber via the grooves 54 and the vent 58 into the beverage within the vessel to create frothing.

FIG. 9 shows a vessel and closure incorporating yet another modified gassing or jetting device. The vessel and closure are similar to those disclosed in FIG. 2 and so are similarly referenced. The tube and closure of the jetting device are generally similar to those of FIGS. 9 and 12 and so similar parts are similarly referenced but with the suffix A.

The main difference over the jetting device of FIGS. 9 to 12 is that the closure 52A once fitted does not permit any relative movement to the tube 50. Thus, the ribs 66A and 56A are permanently held in contact and there are no grooves 54.

The abutment 68A has an annular skirt 70A which encircles the lower end of the tube 50A.

When the device is fitted to the closure 12 and just prior to the closure 12 being fitted to the vessel, the lower end of the closure 52A is punctured to allow for the ingress and subsequently egress of fluid.

We claim:

1. A pressurizable container comprising a wide mouthed vessel and a removable closure to close the mouth of the vessel, the closure including a circular disc, a flexible annular flange extending around the disc and arranged to be urged against the inner wall of the vessel when the container is pressurized, and pressure release means in the disk for venting the vessel to release the pressure on the flange, characterized in that the disc is dome shaped in a direction extending into the vessel whereby, when pressurized, the disk is subject to circumferential expansion to augment the direct pressure on the flange caused by internal pressurization of the vessel.

2. A container according to claim 1, characterized in that the flange has pan outer circumferentially extending recess to provide two axially spaced circumferentially extending areas of contact with the inner wall of the vessel.

3. A container according to claim 1, characterized by locking means located at one axial end of the flange to extend around the rim of the vessel lo lock the closure to the vessel.

4. A container according to claim 3, characterized in that said locking means comprises a screw thread engaging a corresponding screw thread on the vessel.

5. A container according to any preceding claim, wherein the inner face of the mouth of the container and the outer face of the flange, when in its relaxed state, are convergent in a direction towards the base of the container.

6. A container according to claim 1, characterized by a jetting device mounted on said circular disk to extend downwardly into the container to effect a jetting action into the container when the pressure is on the flange released.

7. A container according to claim 6, characterized in that said jetting device comprises a body defining a chamber having an opening, a closure device slidably engaging said opening and constrained in said opening for movement between first and second positions, whereby when in said first position, it closes said opening and in said second position it vents said opening, said closure device being initially assembled into said body in said first position and being moved from said first to said second position immediately prior to installation in said container.

8. A container according to claim 7, characterized in that said body comprises a first cylindrical member, and the closure comprises a second cylindrical member telescopically engaged with said first member.

9. A container according to claim 8, characterized by an annular seal rigid with one said member and located between the outer surface of the second member and the inner surface of the first member, there being axially extending grooves in said other member over a limited axial extent of the said other member so that when the seal is displaced to engage said axial extent, the grooves provide a by-pass path between the first and second members.

10. A container according to claim 8, characterized by stop means for limiting the range of axial displacement of the first member relative to the second member.

11. A container according to claim 6, characterized in that said Jetting device comprises an elongate body defining a chamber open at one axial end and a closure device for sealingly closing said open axial end to hold a predetermined gas environment within said chamber and the closure being movable to vent said chamber just prior to installation in said container.

12. A container according to claim 11, characterized by a passage in the wall of one of said body and closure device which is open when said closure device is in a first position relative to said body, and closed when said closure device is in second position relative to said body.

13. A container according to claim 12, wherein the closure device is cylindrical and telescopically engaged with said body.

14. A container according to claim 12 or claim 13, characterized by means operable once said closure device engages said body to imprison said closure device for movement only between the first and second positions.

15. A closure for a wide mouthed pressurizable container, said container incorporating a jetting device arranged when the closure is in position to extend downwardly into a liquid in the container, said jetting device comprising a body defining a chamber having an opening, a closure device slidably engaging said opening and constrained in said opening for movement from a first to a second position in response to the application of an external force, whereby when in said first position, it closes said opening to seal the chamber from the surrounding atmosphere, and when in said second position it vents said opening, said closure device being moved from said first to said second position immediately prior to installation in said container where after any pressure applied to said container is communicated to said chamber via said opening.

16. A closure according to claim 15, wherein said body comprises a first cylindrical member, and the closure comprises a second cylindrical member telescopically engaged with said first member.

17. A closure according to claim 16, including an annular seal rigid with one said member and located between the outer surface of the second member and the inner surface of the first member, there being axially extending grooves in said other member over a limited axial extent of the said other member so that when the seal is displaced to engage said axial extent, the grooves provide a by-pass path between the first and second members.

18. A closure according to claim 17, including stop means for limiting the range of axial displacement of the first member relative to the second member.

19. A closure for a wide mouth pressurizable container, said closure incorporating a jetting device arranged to depend downwardly into the container, the device comprising an elongate body defining a chamber open at one axial end and means for sealingly closing said open axial end to hold a predetermined gas environment within said chamber and the closure means being movable to vent said chamber just prior to installation in said container.

20. A closure according to claim 19, including a passage in the wall of one of said body and closure means which is open when said closure means is in a first position relative to said body, and closed when said closure means is in second position relative to said body.

21. A closure according to claim 20, wherein the closure device is cylindrical and telescopically engaged with said body.

22. A closure according to claim 20 or claim 21, including means operable once said closure means engages said body to imprison said closure means for movement only between the first and second positions.

23. A closure according to any one of claims 15 to 21, having a socket on its underside into which said jetting device is rigidly secured.

24. A method of assembling a pressurized wide mouth container, comprising the steps of providing a closure incorporating a downwardly depending jetting device having two telescopically mating parts which when in the extended position define a closed chamber and when in the contracted position define a chamber with an opening, filling the chamber with a predetermined gas, holding the gas in the chamber by maintaining the jetting device in the extended position, applying the closure to the container, pressurizing the container and displacing the jetting device to the contracted position prior to pressurization of the container to ensure pressure equalization between the container and chamber.

* * * * *